US010820666B1

(12) United States Patent
Lin

(10) Patent No.: US 10,820,666 B1
(45) Date of Patent: Nov. 3, 2020

(54) HIGH SECURITY BUCKLE

(71) Applicant: Duraflex Hong Kong Limited, Hong Kong (CN)

(72) Inventor: Po Chu Lin, Taipei (TW)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 16/716,757

(22) Filed: Dec. 17, 2019

(51) Int. Cl.
*A44B 11/26* (2006.01)

(52) U.S. Cl.
CPC ..... *A44B 11/266* (2013.01)

(58) Field of Classification Search
CPC ..... A44B 11/266; Y10T 24/45581
See application file for complete search history.

(56) References Cited

U.S. PATENT DOCUMENTS 5,144,725 A * 9/1992 Krauss ..... A44B 11/266 24/616
5,311,649 A * 5/1994 Suh ..... A44B 11/266 24/616
5,383,257 A * 1/1995 Krauss ..... A44B 11/266 24/616
5,791,026 A 8/1998 Anscher
6,311,374 B1 11/2001 Anscher
7,181,936 B2 * 2/2007 Christensen ..... A44B 11/266 70/389
7,219,406 B2 * 5/2007 Chui ..... A44B 11/266 24/593.1
8,176,605 B2 * 5/2012 Mok ..... A44B 11/266 24/613
8,281,464 B2 * 10/2012 Shen ..... A44B 11/266 24/614
8,720,018 B2 * 5/2014 Yoshie ..... A44B 11/266 24/615
9,032,767 B2 * 5/2015 Takahashi ..... A44B 11/2573 70/58
10,051,921 B2 * 8/2018 Chun ..... A44B 11/2519
10,226,106 B2 * 3/2019 Postolek ..... A44B 11/2573
2004/0226150 A1 * 11/2004 Beletsky ..... A44B 11/266 24/625

* cited by examiner

*Primary Examiner* — Robert Sandy
*Assistant Examiner* — Louis A Mercado
(74) *Attorney, Agent, or Firm* — Collard & Roe, P.C.

(57) ABSTRACT

A buckle portion has a buckle body, at least one elastic locking leg connected to the buckle body, and a locking element comprising a plate having an actuation element. The locking element is connected to the elastic locking leg and is movable relative to the elastic locking leg by moving the actuation element between a locked position and an unlocked position. In the unlocked position, the elastic locking leg is movable so as to release the buckle portion from a corresponding buckle receptacle. In the locked position, the locking element prevents flexing of the elastic locking leg even under external pressure to keep the buckle portion from being released.

13 Claims, 5 Drawing Sheets

HIGH SECURITY BUCKLE

BACKGROUND OF THE INVENTION

1. Field of the Invention

This invention relates to a two-piece buckle for securing ends of webbing to each other. In particular, the invention relates to a buckle that has a locking mechanism that prevents unlocking of the buckle when the locking mechanism is engaged.

2. The Prior Art

In conventional two-piece buckles, the male portion has locking elements that engage corresponding elements in the female portion to secure the two buckle portions together. In a side-release type buckle, the male portion has two locking legs that engage into two slots in the female portion. Pressing the locking legs inward through the slots allows the male portion to be released from the female portion.

While this is a convenient and simple way to secure the buckle, it would be desirable to add an extra security feature so that the buckle cannot be unlocked in this manner when the security feature is engaged. This would deter theft as well as make the buckle safer around young children and infants.

U.S. Pat. No. 6,311,374 discloses a side-release buckle with a security function in the form of a push button on the male part that interacts with a catch on the female part to lock the two parts together. The buckle is released only by simultaneously pressing on the push button while pressing the locking legs of the male portion together. While this is an effective security measure, it generally requires two hands to operate, and requires simultaneous action between the two locking elements.

SUMMARY OF THE INVENTION

It is therefore an object of the invention to provide a buckle having a secondary locking mechanism that can be selectively engaged by the user when extra security is desired. It is another object of the invention to provide a buckle in which the locking mechanism is easy to operate with a single hand.

This object is achieved according to the invention by a buckle portion comprising a buckle body, at least one elastic locking leg connected to the buckle body, and a locking element comprising a plate having an actuation element. The locking element is connected to the elastic locking leg and is movable relative to the elastic locking leg by moving the actuation element between a locked position and an unlocked position. In the unlocked position, the elastic locking leg is movable so as to release the buckle portion from a corresponding buckle receptacle. In the locked position, the locking element prevents flexing of the elastic locking leg even under external pressure to keep the buckle portion from being released.

In one embodiment, the connection between the elastic locking leg and the locking element comprises a protrusion located on the at least one locking leg, and at least one locking slot located on the locking element. The locking element is connected to the buckle body by placing the protrusion through the at least one locking slot. In the unlocked position, the protrusion is located at one end of the locking slot and in the locked position, the protrusion is located at an opposite end of the one locking slot. In a preferred embodiment, the locking slot is V-shaped with a vertex and two legs. In the unlocked position, the protrusion is located at the vertex, and in the locked position, the protrusion is located at a tip of one of the legs, in particular at a tip of the outside leg on each side of the buckle portion. Due to the location at the vertex, pressing on the locking legs causes the protrusion to move along one of the legs of the locking slot, allowing the locking leg to flex until the end of the locking slot is reached. In the locked position, the location of the protrusion at the end of one of the legs of the V-shaped slot prevents any movement of the leg, as the protrusion already abuts the end of the slot and cannot travel any further.

In order to keep the locking element securely connected to the at least one locking leg, the locking element preferably comprises an additional plate connected to the plate via sidewalls, such that the at least one locking leg is disposed between the two plates when the at least one locking leg is connected to the locking element.

Preferably, the buckle portion has two elastic locking legs that extend parallel to one another from the buckle body, and each locking leg has two protrusions, extending on each of the front and back sides of each of the locking legs. The plate and additional plate each comprise two locking slots, so that each protrusion extends through one of the locking slots to connect the locking element to the locking legs.

In one embodiment, the actuation element comprises a flange that extends outward from one of the plates of the locking element. The flange can contain a groove extending across a longitudinal extent of the flange. This groove allows a finger to have additional grip on the flange when moving the flange between the locked position and unlocked position.

The protrusion is preferably located on an interior edge of the at least one locking leg, so that when there are two locking legs, the protrusions are located both at an interior edge. The vertex of each of the locking slot is located at a bottom corner of the plate. Thus, when the protrusions are disposed in the vertex of the locking slots in the unlocked position, the user can flex the locking legs by pressing inwardly on them. During the flexing, the protrusion slides up an inside one of the legs of the V-shaped locking slot. In the locked position, the protrusions are located at an end of the outside leg of each V-shaped slot, so that inward pressure on the locking legs does not allow the protrusions to move anywhere, and flexing of the legs is prevented. In both the locked and unlocked positions, the locking element prevents outward flexing of the locking legs, thus adding stability to the buckle portion, as the legs cannot be stressed and possibly broken by outward pulling on the legs.

This configuration is especially useful, when the buckle portion described above is part of a two-piece side release buckle assembly. The buckle portion is insertable into a female buckle receptacle having a hollow body with an interior cavity, an open end, a cutout in the hollow body, and two side openings in the hollow body for receiving the two locking legs. The buckle portion is connected to the female receptacle by inserting the locking legs into the cavity until the locking legs extend through the side openings and snap into place, and the buckle portion is disconnected from the female portion by pressing the locking legs together until the locking legs clear the side openings. The use of the locking element prevents release of the buckle portion from the female receptacle when the actuation element is moved into the locked position, as the locking legs cannot be pressed inward to release the buckle portion from the receptacle.

In this embodiment, the actuation element in the form of the flange extends through the cutout in the female receptacle so as to be accessible by a user when the buckle portion is connected to the female receptacle. The present invention provides a unique and simple way to add extra security to a buckle assembly, making it safer around young children, and theft deterrent, while still being easy to activate and deactivate. In the present invention, the user must first slide the actuation element into the unlocked position, freeing the legs, in order to release the buckle assembly. The sliding motion on the actuation element must occur prior to pressing on the locking legs to release the male buckle portion. The user can also keep the buckle assembly in the unlocked position if regular operation of the buckle assembly without the enhanced security is desired.

In addition, the buckle assembly of the present invention exhibits an enhanced anti-break function. Compared with common side release buckles, this construction can prevent the two elastic arms of male buckle portion from bending outwards all the time, and can prevent the two arms from being damaged from pulling due to improper insertion of the male buckle into female buckle.

The buckle according to the present invention also allows operation with one hand in different steps: Different segments provide different functions without compromising each other; and the buckle can be adjusted and used with one hand, thereby providing the maximum convenience and being far superior other buckles with security functions, such as that disclosed in U.S. Pat. No. 6,311,374, which requires two hands to operate.

The present invention also provides for enhanced performance of the buckle: when in a locked state, this product is integrally converted into a rigid body, which can bear the pulling of woven belts at both ends to the maximum extent, ensuring the safety of cases and bags.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
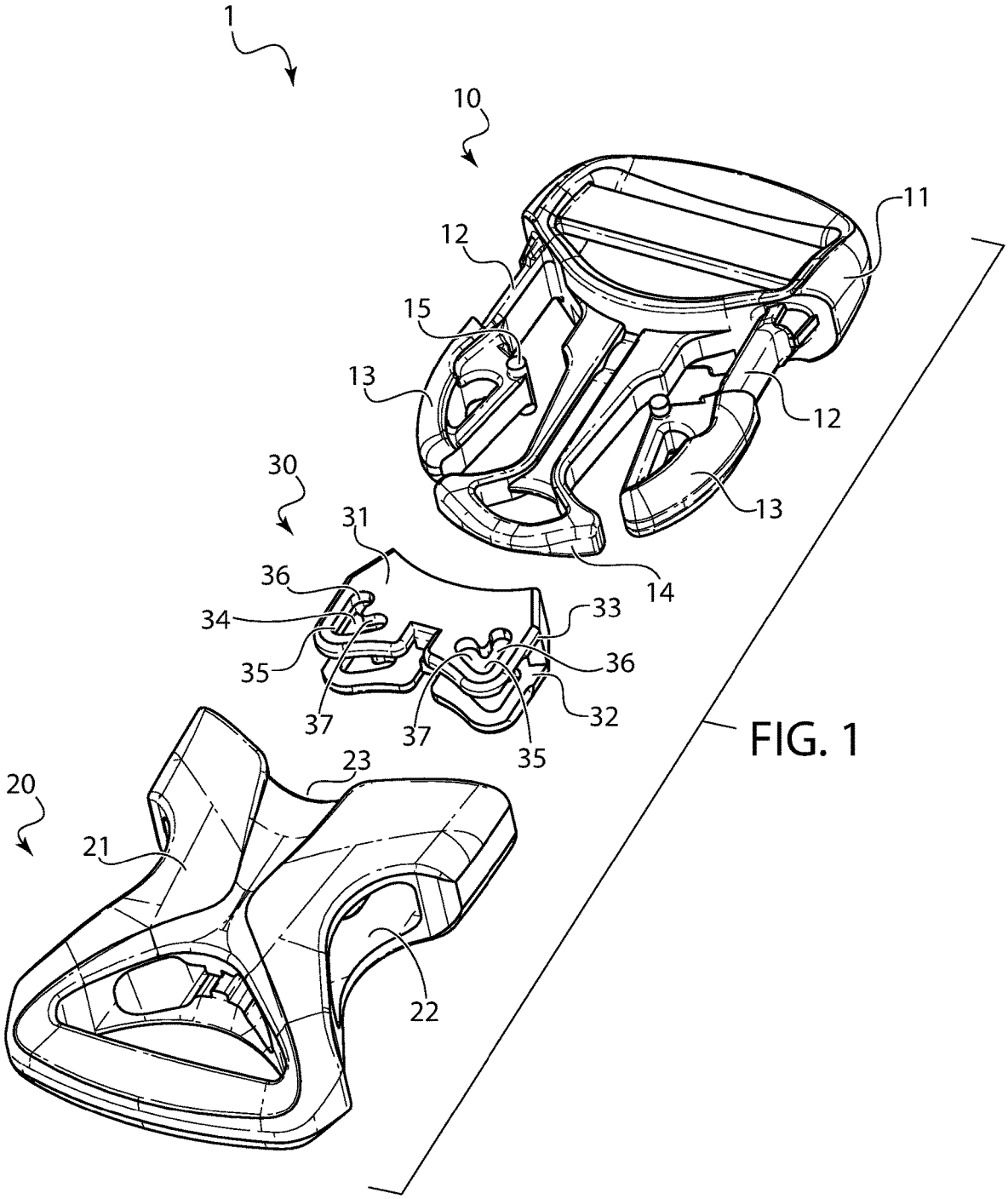
FIG. 1 shows an exploded view of a buckle assembly according to the invention.

Referring now in detail to the drawings and, in particular, FIG. 1 shows an exploded view of the buckle assembly 1 according to the invention. The buckle assembly consists of a male buckle portion 10, a female receptacle 20 for receiving male buckle portion 10, and a locking element 30, which is connected to the male buckle portion 10 as shown in FIG. 2.

Figure 4:
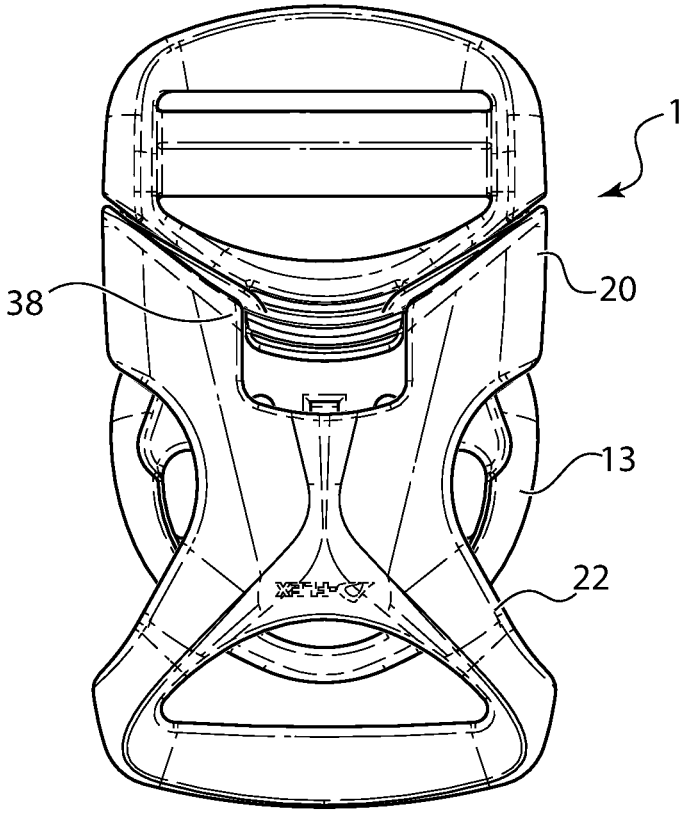
FIG. 4 shows the buckle assembly of FIG. 3 fully assembled and in the unlocked position.
Figure 6:
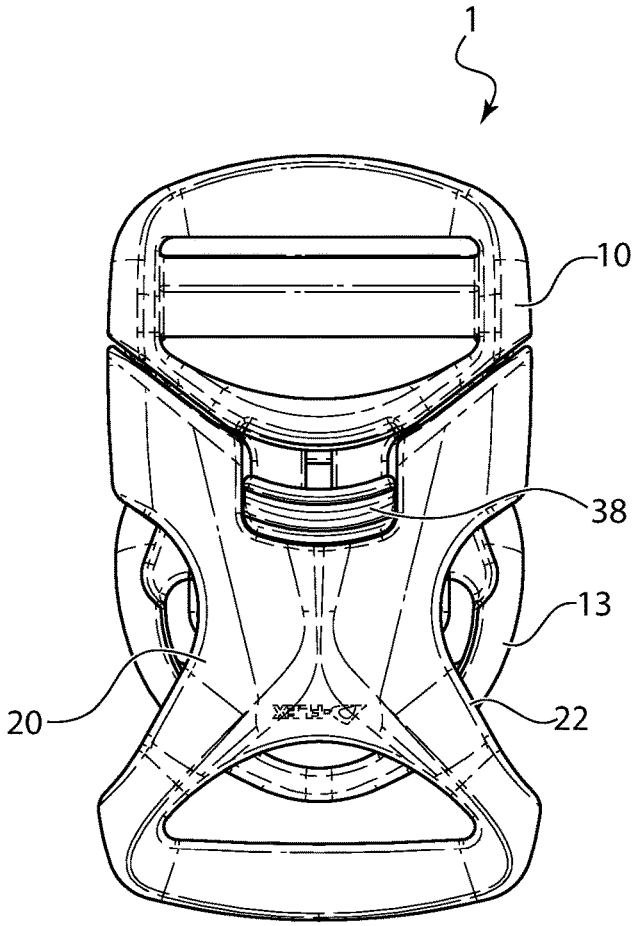
FIG. 6 shows the buckle assembly in the locked position.

Male buckle portion 10 in this embodiment is a male portion of a side release type buckle, having a buckle body 11 connected to a central leg 14 and two locking legs 12, each having an engagement end 13, which in the assembled position shown in FIGS. 4 and 6, extends through side openings 22 in the hollow body 21 of female receptacle 20 to lock male buckle portion 10 to female receptacle 20. Pressing engagement ends 13 inwardly toward each other allows male buckle portion 10 to be released from female receptacle 20. This operates in the usual manner of a side release buckle, except that in the present invention, a locking element 30 is now present, which can prevent release of the male buckle portion 10 from female receptacle 20.

Locking element 30 is formed of a front plate 31, a rear plate 32, and side walls 33 connecting the front and rear plates 31, 32. Two V-shaped locking slots 34 are located on each of the front plate 31 and rear plate 32, at lower outside corners thereof. Each of the V-shaped locking slots 34 has a vertex 35 and two legs: an outside leg 36 and inside leg 37.

Figure 2:
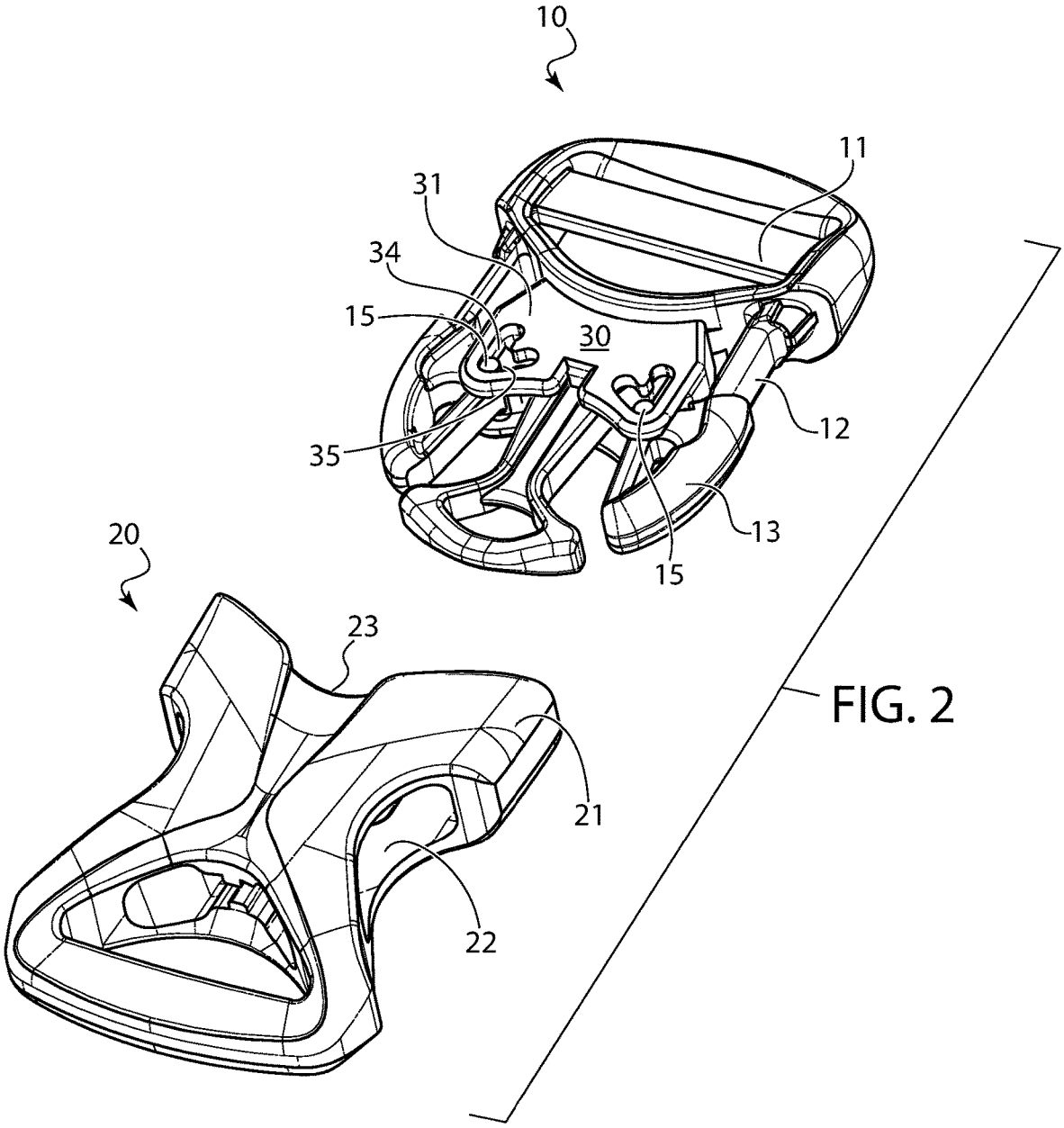
FIG. 2 shows the buckle assembly of FIG. 1, with the locking element assembled on the buckle portion.
Figure 3:
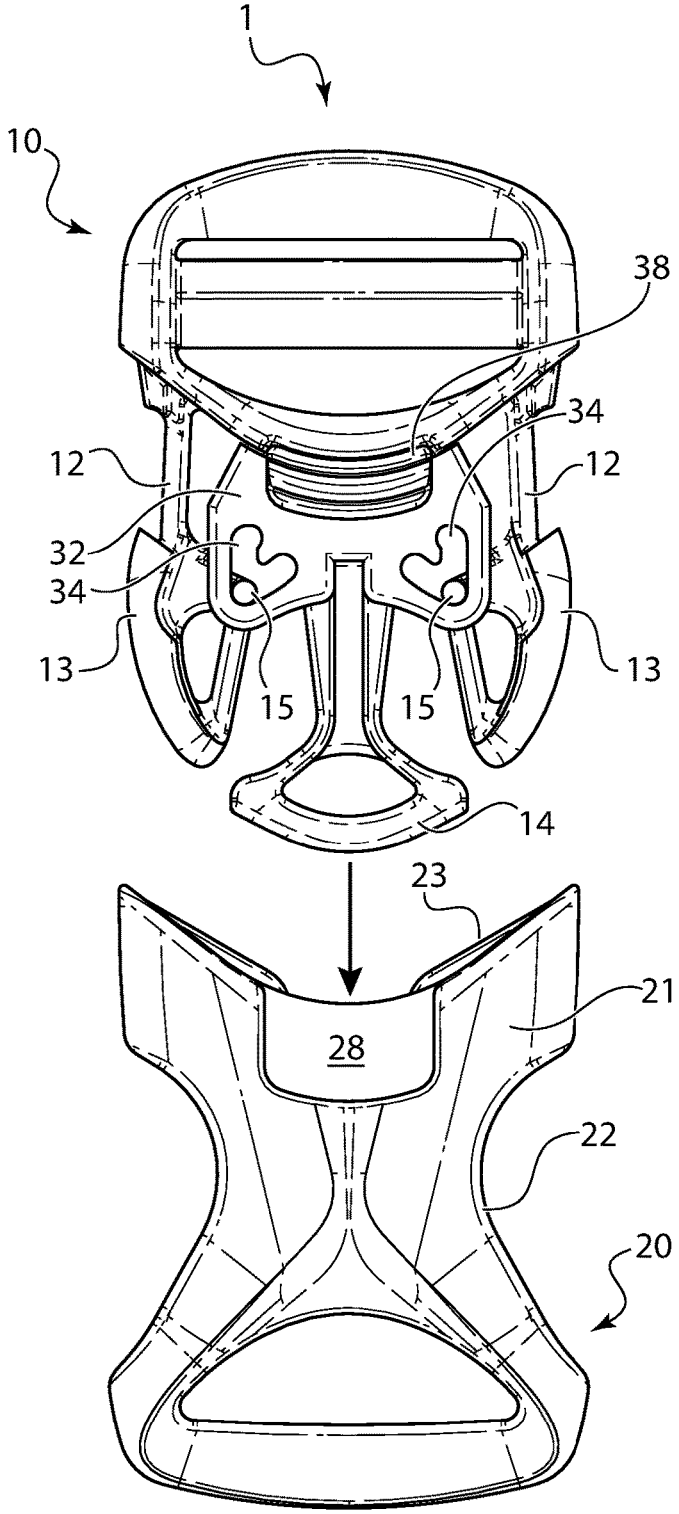
FIG. 3 shows the buckle assembly of FIG. 2 in a rear view.

Correspondingly, male buckle portion 10 has protrusions 15 located on each of the locking legs 12 that fit into locking slots 34 on locking element 30 to secure locking element 30 to male buckle portion 10, as shown in FIGS. 2 and 3.

Figure 3A:
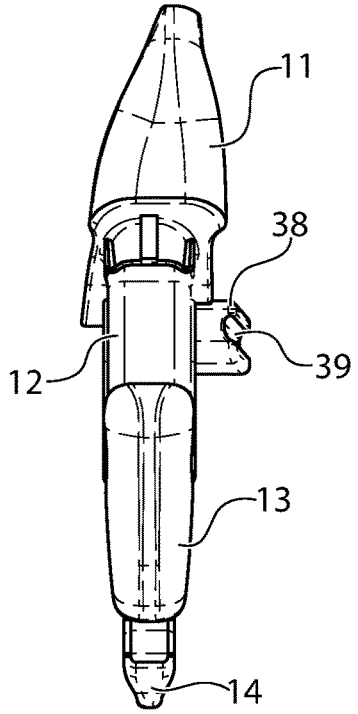
FIG. 3*a* shows a side view of the buckle portion shown in FIG. 3.

FIG. 3 shows a rear view of buckle assembly 1. In this view, it can be seen that rear plate 32 has an actuator 38 disposed at a top edge thereof. Actuator 38 is in the form of a flange that has a groove 39 running across its width, as can be seen in the side view in FIG. 3A. In the assembled state, actuator 38 projects outwardly from buckle assembly 1 through a cutout 28 in female receptacle 20 so is accessible to a user when the buckle assembly 1 is fully assembled.

Figure 5:
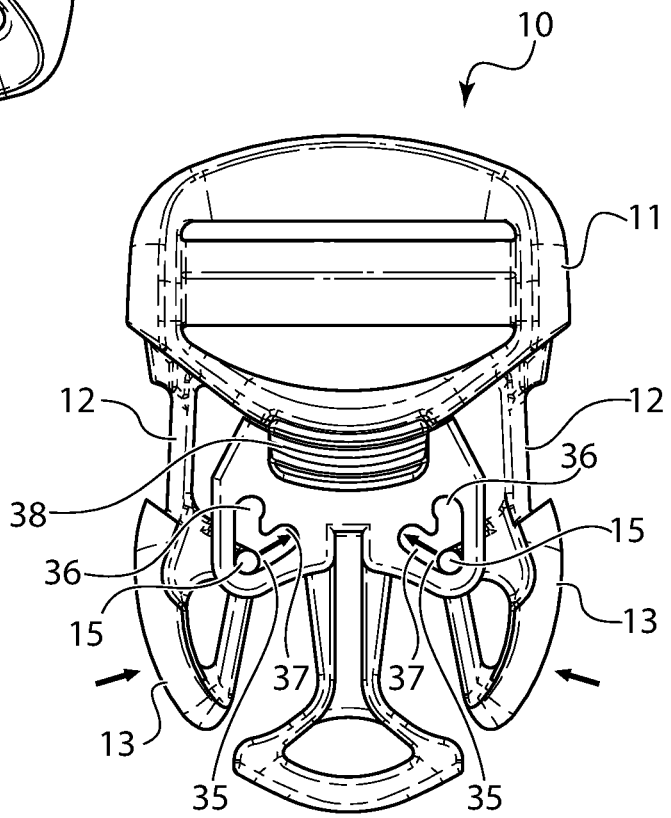
FIG. 5 shows the buckle portion of FIG. 4 in the unlocked position.
Figure 7:
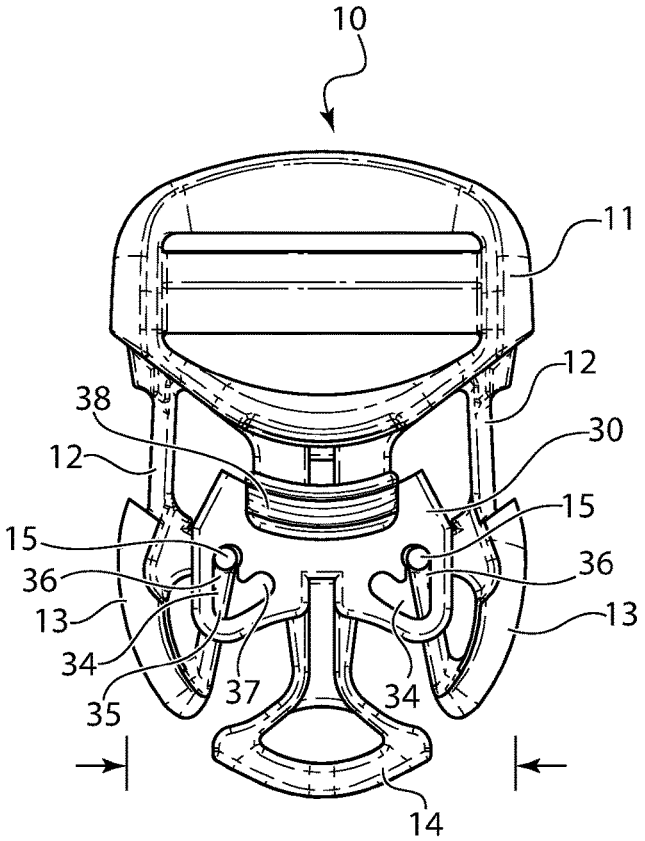
FIG. 7 shows the buckle portion in the locked position.

The operation of locking element can be seen in FIGS. 4-7. FIGS. 4 and 5 show buckle assembly 1 and male buckle portion 10 respectively in the unlocked state, and FIGS. 6 and 7 show buckle assembly 1 and male buckle portion 10 in the locked state respectively.

In the unlocked state shown in FIGS. 4 and 5, locking element 30 is slid upward via actuator 38 until protrusions 15 rest within the vertices 35 of locking slots 34. In this state, pressing engagement ends 13 inward allows protrusions 15 to slide within locking slots 34 until they reach the end of inside leg 37 of locking slots 34, giving the locking legs 12 enough clearance to exit female receptacle 20. This allows buckle assembly to operate in the same manner as a traditional side-release buckle. However, locking element 34 adds extra stability to locking legs 12, as locking element 34 prevents outward movement of locking legs 12 due to the shape of locking slots 34, and thus prevents breakage and undue strain on the buckle portion 10.

In the locked position shown in FIGS. 6 and 7, release of male portion 10 from female receptacle 20 is prevented by locking element 30. To move the locking element 30 from the unlocked position to the locked position, the user slides actuator 38 downward, which causes locking element to slide downward until protrusions 15 move from being disposed in vertex 35 to the tip of outside legs 36 of locking slots 34, as shown in FIG. 7. In this position, inward pressure on engagement ends 13 will not move locking legs 12 inward, as the edges of locking slots 34 prevent protrusions 15 from moving inwardly at all. Outward movement is also prevented in this position. The only way to release male buckle portion 10 from female receptacle 20 is to first slide actuator 38 back to the unlocked position show in FIGS. 4 and 5. The sliding of actuator 30 and the pressing of engagement ends 13 to release male buckle portion 10 from female receptacle 20 can take place using the same hand.

The present invention provides an extra security measure against theft, because when the buckle assembly 1 is in the locked position, two separate actions are required for unlocking, thus taking more time and attracting more attention, and the mechanism for moving the locking element to the unlocked position may not be visible or apparent to a thief passing by. In addition, the locking element provides extra safety when used around young children, as the children may not be aware of the need to move the locking mechanism into the unlocked position prior to release of the male buckle portion from the female receptacle.

Accordingly, while only a few embodiments of the present invention have been shown and described, it is obvious that many changes and modifications may be made thereunto without departing from the spirit and scope of the invention.

What is claimed is:

1. A buckle portion comprising:

a buckle body, at least one elastic locking leg connected to the buckle body, a locking element comprising a plate having an actuation element, the locking element being configured for connection to the at least one locking leg, and a protrusion located on the at least one locking leg, and at least one locking slot located on the locking element, wherein the locking element is movable relative to the at least one locking leg by sliding the actuation element between a locked position and an unlocked position, wherein in the unlocked position, the elastic locking leg flexes under external pressure, and wherein in the locked position, the locking element prevents flexing of the elastic locking leg under external pressure, wherein the locking element is connected to the at least one locking leg by placing the protrusion through the at least one locking slot, and wherein in the unlocked position, the protrusion is located at one end of the at least one locking slot and in the locked position, the protrusion is located at an opposite end of the at least one locking slot.

2. The buckle assembly according to claim 1, wherein the at least one locking slot is V-shaped with a vertex and two legs, and wherein in the unlocked position, the protrusion is located at the vertex, and in the locked position, the protrusion is located at a distal end of one of the legs.

3. The buckle portion according to claim 2, wherein the protrusion is located on an interior edge of the at least one locking leg.

4. The buckle portion according to claim 2, wherein the vertex of the locking slot is located at a bottom corner of the plate.

5. The buckle assembly according to claim 1, wherein the locking element comprises an additional plate connected to the plate via sidewalls, such that the at least one locking leg is disposed between the two plates.

6. The buckle portion according to claim 5, wherein the buckle body has two elastic locking legs, wherein each locking leg has two of said protrusions, extending one on each of front and back sides of the locking legs, and wherein the plate and additional plate each comprise two of said locking slots, so that each protrusion extends through a respective one of the locking slots to connect the locking element to the locking legs.

7. A buckle assembly comprising the buckle portion according to claim 6 and a female portion having a hollow body with an interior cavity, an open end, a cutout in the hollow body, and two side openings in the hollow body for receiving the two locking legs, wherein the buckle portion is connected to the female portion by inserting the locking legs into the cavity until the locking legs extend through the side openings, and the buckle portion is disconnected from the female portion by pressing the locking legs together until the locking legs clear the side openings.

8. The buckle assembly according to claim 7, wherein the actuation element extends through the cutout so as to be accessible by a user when the buckle portion is connected to the female portion.

9. The buckle assembly according to claim 8, wherein the locking slots are each V-shaped with a vertex and two legs, and wherein in the unlocked position, the protrusions are located at the vertices, and in the locked position, the protrusions are located at a tip of one of the legs of each locking slot.

10. The buckle assembly according to claim 9, wherein the legs of each locking slot form an interior leg and an exterior leg, wherein in the unlocked position, pressing the locking legs inward causes the protrusions to slide along the interior leg of each locking slot, and wherein in the locked position, the protrusions are located at the end of the exterior leg of each locking slot.

11. The buckle assembly according to claim 7, wherein the sidewalls of the locking element abut the locking legs and prevent outward flexing of the locking legs.

12. The buckle portion according to claim 1, wherein the actuation element comprises a flange that extends outward from the locking element.

13. The buckle portion according to claim 12, wherein the flange contains a groove extending across a longitudinal extent of the flange.

* * * * *